United States Patent [19]

McMullen

[11] 4,211,311

[45] Jul. 8, 1980

[54] RAILWAY CAR TRUCK AND BRAKE SUPPORT STRUCTURE

[75] Inventor: John C. McMullen, Broomall, Pa.

[73] Assignee: The Budd Company, Troy, Mich.

[21] Appl. No.: 954,344

[22] Filed: Oct. 25, 1978

[51] Int. Cl.[2] ..... B61H 13/36

[52] U.S. Cl. ..... 188/209; 105/206 R; 188/52

[58] Field of Search ..... 188/209, 207, 212, 213, 188/214, 215, 233.3, 49, 50, 51, 52, 53, 54, 55; 105/206 R, 206 A

[56] References Cited

U.S. PATENT DOCUMENTS

| | | | |
|---|---|---|---|
| 957,408 | 5/1910 | Braham et al. | 188/53 |
| 1,588,181 | 6/1926 | Gallagher | 188/209 |
| 2,093,797 | 9/1937 | Baselt | 188/209 X |
| 2,170,112 | 8/1939 | Busch | 188/212 |
| 2,383,955 | 9/1945 | Busse | 188/212 |
| 2,710,676 | 6/1955 | McCormick | 188/52 X |
| 2,908,230 | 10/1959 | Dean | 105/182 R |

*Primary Examiner*—George E. A. Halvosa
*Attorney, Agent, or Firm*—A. L. Trueax, Jr.

[57] ABSTRACT

A railway car truck includes two pairs of brake support guide assemblies connected to the side frames between the front and rear sets of wheels of the car. The support assemblies support and guide the nub ends of two brake units. The support assemblies include main support members adapted to be permanently mounted to the side frames. Additional plates with guide elements are readily attachable to the main support members to make the truck adaptable to receive different size wheel sets.

10 Claims, 6 Drawing Figures

RAILWAY CAR TRUCK AND BRAKE SUPPORT STRUCTURE

Railway car trucks of the general type disclosed in U.S. Pat. No. to W. B. Dean 2,908,230 have been used for many years. In most cases, the trucks have been designed for particular types of brake systems, with any change in the physical requirements of the trucks generally necessitating a rearrangement of the physical parts of the brake system.

It is desirable to have trucks which are readily adaptable to accept different size wheel sets. Preferably it is desirable that the major construction for accommodating the brake requirements for the different size wheels be done at the factory where the trucks are assembled. This eliminates the need for major changes in the truck structure at the site where facilities for making such changes are often lacking.

Railway cars made for foreign export, ofter require different size wheel sets. Generally, the use of different size wheels makes it difficult to design a single brake guide support assembly in the same truck and still have the assembly accommodate different size wheels.

It is an object of this invention to provide an improved truck having means to accommodate wheel sets of different sizes.

It is a further object of this invention to provide an improved brake support assembly in which the same basic structure for the main parts of the assembly are permanently installed in the trucks and which may be used with different wheel sets.

In accordance with the present invention, a railway car truck includes a pair of articulated sideframes. Four identical main support members are permanently secured to the sideframes, two on each side, to support the structures of a pair of brake units. Two similar sets of brake support guide members are connected to the main support assemblies. The same support members may be used for different size wheel sets with no changes to the structure of the truck or main support members and only minor adjustments of the brake guide members.

Other objects and advantages of the present invention will be apparent and suggest themselves to those skilled in the art, from a reading of the following specification and claims, taken in conjunction with the accompanying drawings which:

Figure 1:
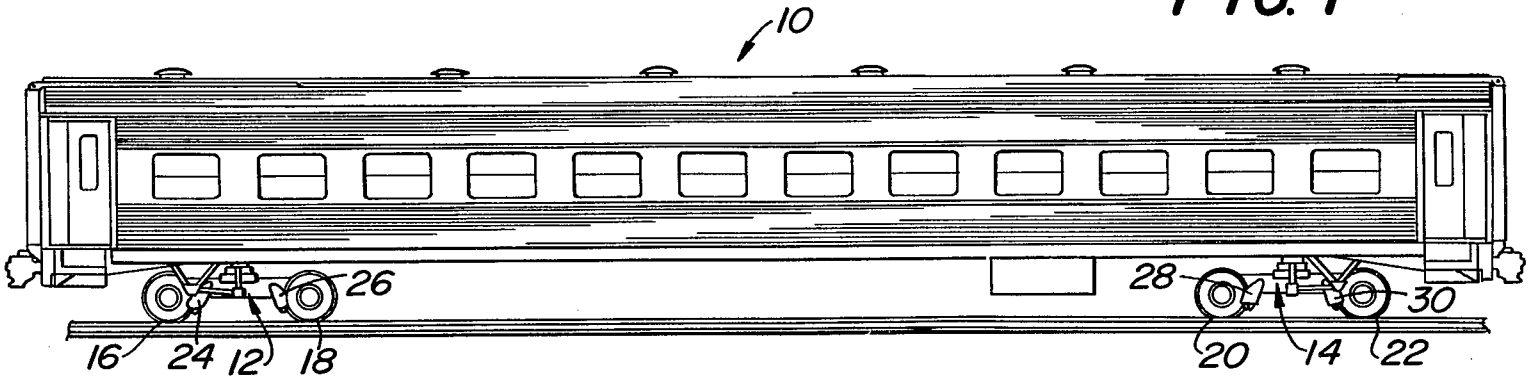
FIG. 1 is a side view of a typical railway car including trucks and brake guide assemblies, in accordance with the present invention.

Referring particularly to FIG. 1, a typical railway car 10 comprises a pair of trucks 12 and 14 disposed toward the front and rear ends to support the car body. The truck 12 includes a front or outboard set of two wheels 16 and a rear or inboard set 18. Likewise the truck 14 comprises a front or inboard set of two wheels 20 and a rear or outboard set 22. Brake support and guide assemblies 24 and 26 are connected to the sideframe of the truck 12 to support and guide brake units to brake the wheel sets 16 and 18, respectively. Brake support and guide assemblies 28 and 30 are connected to the sideframe of the truck 14 to support and guide a brake unit to brake the wheel sets 20 and 22, respectively. Similar support and guide assemblies are disposed on both sides of the trucks. Both trucks 12 and 14 are identical and only the truck 14 will be described.

Figure 2:
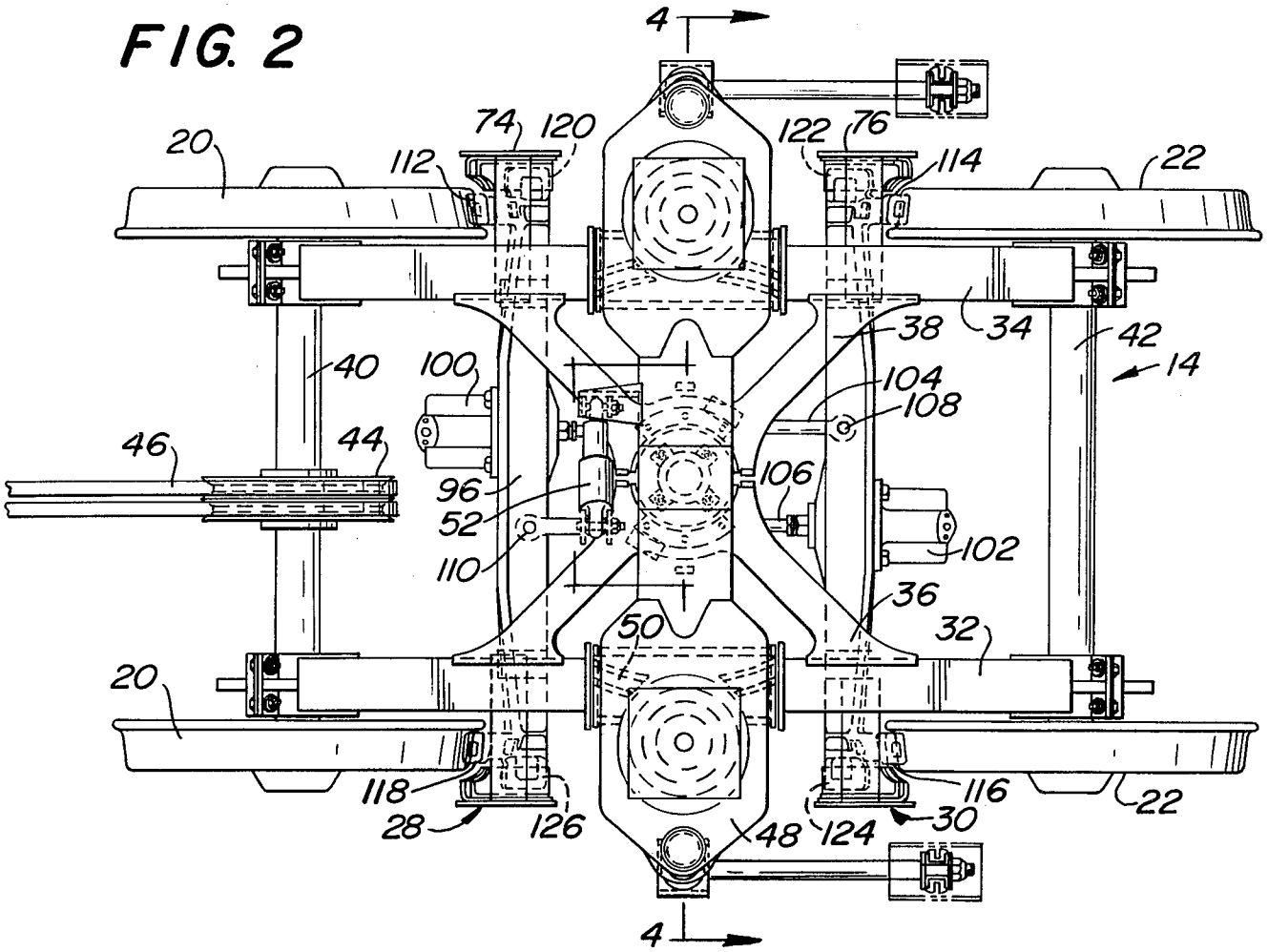
FIG. 2 is a top view of one of the trucks illustrated in FIG. 1.
Figure 3:
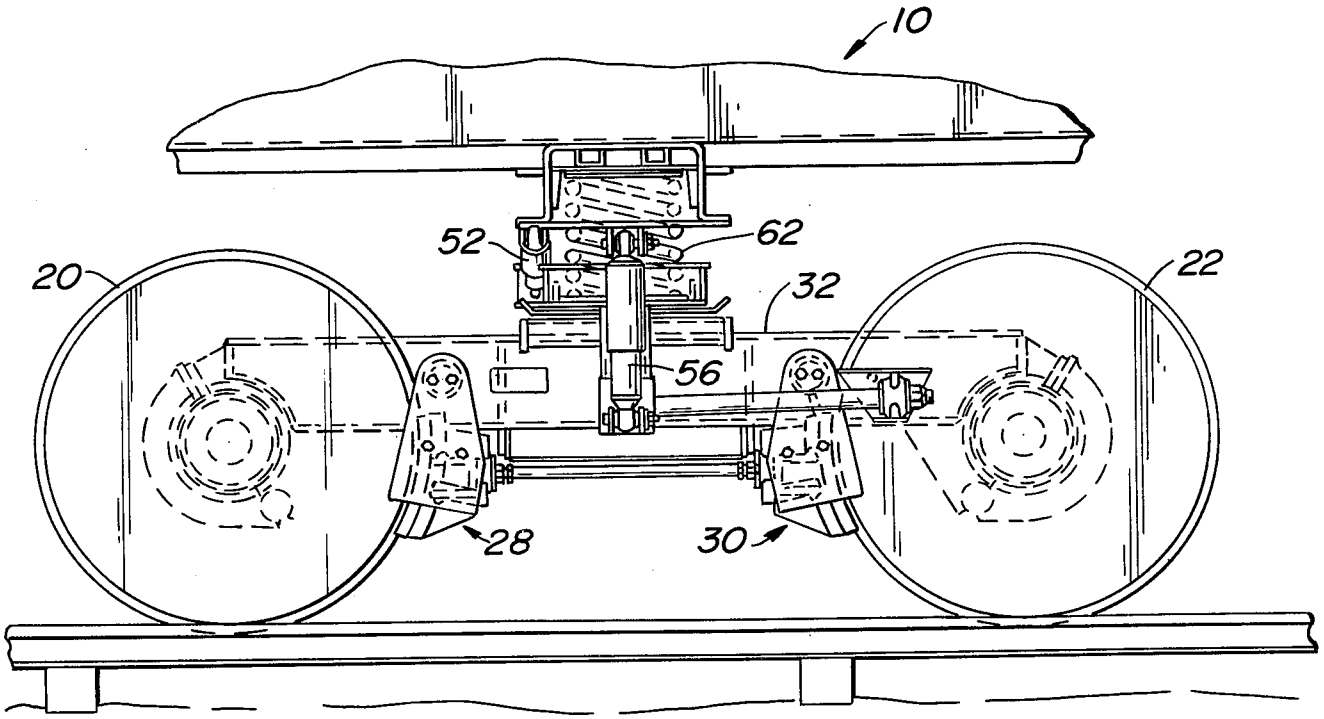
FIG. 3 is a side view of the truck illustrated in FIG. 2.
Figure 4:
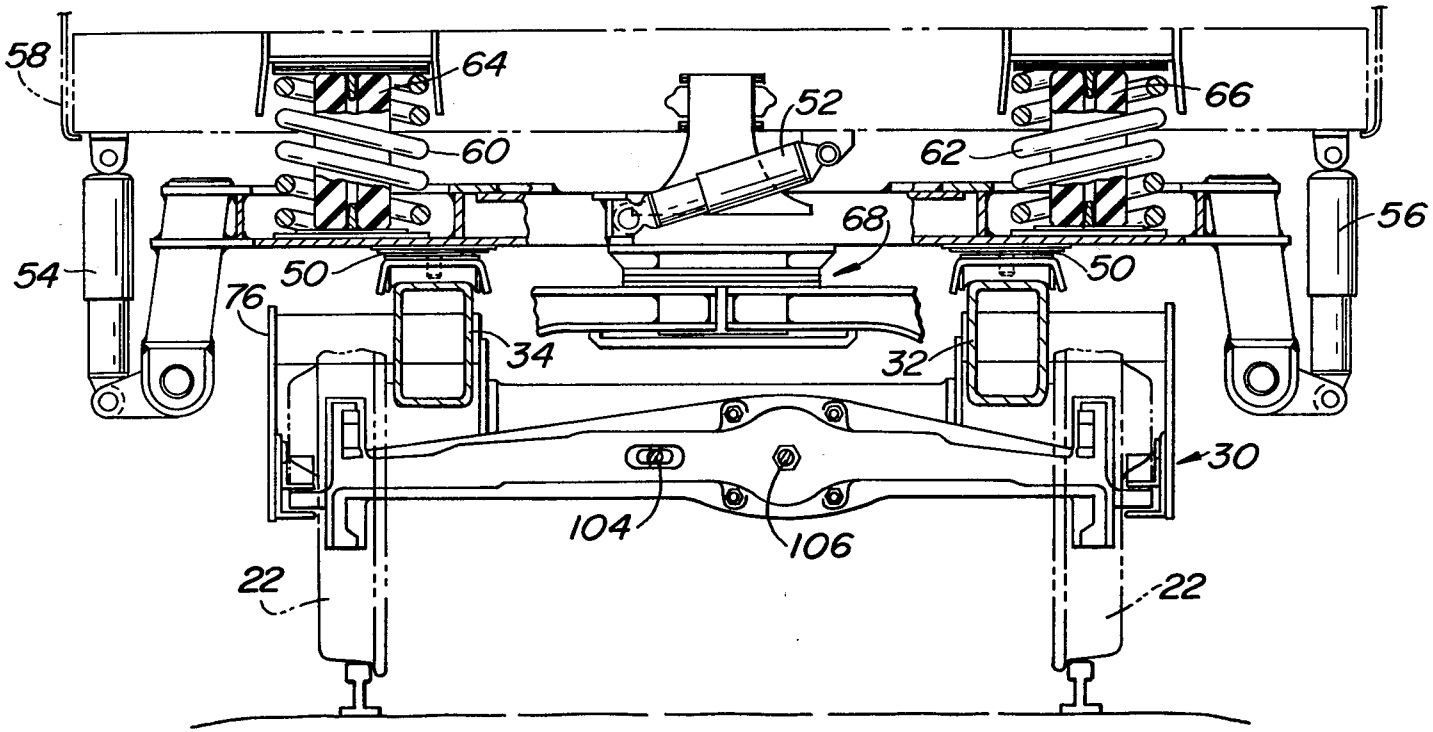
FIG. 4 is a cross-sectional view taken along lines 4—4 of FIG. 2.

Referring to FIGS. 2, 3 and 4, the truck 14 includes a pair of sideframes 32 and 34. The sideframes 32 and 34 each include a "V" member 36 and 38 welded to the interiors of the side frames. The two side frames extend inwardly toward each other to form a spider arrangement with a central opening. This arrangement is similar to the arrangement described in the aforementioned patent to Dean. An axle 40 forms part of the wheel set 20 and extends through the sideframes 32 and 34 to support the wheels. The axle 42 forms part of the wheel set 22 and extends through the sideframes 32 and 34 to support the wheels. The axle 40 drives a pulley arrangement including a pulley wheel 44 and belt 46. Rotation of the axle 40 is used to drive a generator in the car. This feature is not related to the present invention. Also, no means for driving the axles are illustrated because the car may be hauled and also such means are not related to the invention. The various mountings and bearings for the axle with the sideframes and for the wheel connections on the axles are conventional and therefore not shown or described in detail.

A bolster 48 is supported transversely on the sideframes 32 and 34. Slide bearings 50 are disposed between the bolster 48 and wear plates on the sideframes 32 and 34. The slide bearings 50 permit the bolster 48 to be turnable or slideable with respect to the truck sideframes 32 and 34 about a relatively small angle during motion of the car.

A lateral shock absorber 52 is connected between the bolster 48 and the main structure under the car. Vertical shock absorbers 54 and 56 are connected between the car body 58 and the bolster 48. The structure of the car body 58 is supported on the bolster by means of a pair of mechanical springs 60 and 62. The suspension includes a second pair of resilient members 64 and 66 which also help support the structure of the car body 58. The bottom of the bolster 48 includes a center locating pin arrangement 68 adapted to fit within the opening provided by the spider arrangement of the "V" shaped members 36 and 38. Conventional means to hold the center structure in position is provided and will not be described.

Many of the parts and arrangements thus far described are conventional and may be used in most conventional trucks. The present invention is directed particularly toward the means and structures for supporting and guiding brake units used to brake the wheels of the car.

Referring to FIGS. 3, 4, 5 and 6, the brake support and guide assemblies 28 and 30 are connected to support brake units to brake one side of wheel sets 20 and 22, on one side of the truck including the sideframe 32. In like manner, support and guide assemblies 74 and 76 are connected to brake units to brake the wheel sets 20 and 22 on the opposite side of the truck including the sideframe 34.

Referring particularly to FIG. 3, it is noted that the assemblies 28 and 30 on one side of the truck are disposed in opposite directions, i.e., with the straight edge of the supports overlapping the wheels. The corresponding supports 74 and 76 are also disposed similarly in opposite directions. The assembly 30 is identical to the assembly 74 disposed diagonally oppositely on the other side of the car. In like manner, the assembly 28 is identical to the assembly 76 diagonally oppositely disposed. Thus, the structure of the assemblies 28,30, 74 and 76 involve a pair of identical assemblies 28 and 76 along with a second pair of identical assemblies 30 and 74. As will be described each of the assemblies comprise a main support means permanently attached to the sideframes of the truck adapted to receive members with angular support elements thereon to accommodate wheels of different sizes. The assemblies 28, 30, 74 and 76 made with substantially identical parts, affords a number advantages in the construction of the truck.

Figure 6:
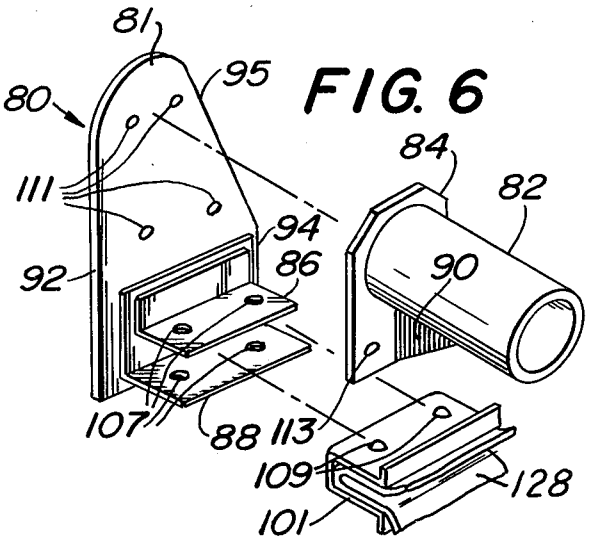
FIG. 6 is an isometric view partly exploded of a main support and guide members assembly along with a nub end of a brake unit, in accordance with the present invention.
Figure 5:
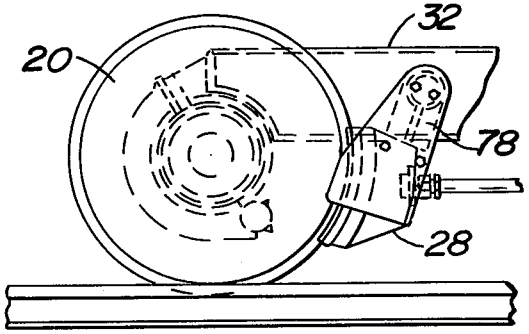
FIG. 5 is a view of one of the main support and guide member assemblies connected to a sideframe in operative relationship with a wheel, in accordance with the present invention.

The truck illustrated in FIG. 3 discloses a certain size wheel, for example 39 inches. The truck illustrated in FIG. 5 is substantially the same structure except that it now illustrates the use of a smaller size wheel, for example 28 inches. In order to compensate for the different size wheels, the assembly 78 illustrated in FIG. 5 is reversed from the position shown by the support means 28 in FIG. 3. When smaller type wheels are shown than those illustrated in FIG. 3, all of the associated support members for supporting the brake units are reversed as far as the exterior appearance is concerned. However, all of the main supporting members for all of the assemblies are of the same construction and are permanently mounted to the truck. Portions of the assemblies include angular guide elements secured to plates which are mounted to the main support members. The same parts are involved in all four assemblies the difference being that the guide elements on the main plate will be on opposide sides and the angular directing elements may require recessing for different size wheel sets. The details of a typical assembly 80 for supporting and guiding is illustrated in FIG. 6. The assemblies 28, 30, 74 and 76 previously described are basically the same as assembly 80.

The brake support and guide 80 includes a main support member comprising a tubular member 82 which is designed to be inserted into a circular opening within the sideframes of the truck. This tubular member is welded or otherwise inserted into the truck as more clearly illustrated in FIG. 4. The tubular member 82 is welded to a plate 84. A gusset 90 is welded between the tubular member 82 and the plate 84. All four main supports are identical and permanently secured to the sideframes of the truck. All are designed to receive additional guide elements which are adapted to accommodate different size wheel sets. These additional elements are readily changeable and may be made up in the field after delivery of the car.

The plate 84 includes four openings 113 adapted to receive bolt or screw attachments to permit attachment of a plate 81, which include openings 111.

The plate 81 includes welded thereto a pair of angular guide support elements 86 and 88 spaced to receive a wear plate 101 therebetween. The plate 81 includes a relatively straight side 92 and sides 94 and 95, which are set at an angle with respect to each other. This facilitates connections for brake units when different size wheel sets are contemplated.

The wear plate 101 includes projections or dimples 109 disposed to snap in place into openings 107 within the angular members 86 and 88. The nob end 128 of the brake unit is disposed to move in and be guided by the wear plate 101 during braking of the wheels.

The brake units to be now described both include ends similar to the end 128 disposed to be supported and guided by assemblies similar to that illustrated in FIG. 6.

The braking units used in the present invention are conventional. Such braking units are manufactured, for example, by Westinghouse Air Brake Division of Wilmerding, Pennsylvania. While such braking units will be described very briefly and generally, they will not be shown or illustrated in detail.

As illustrated in FIG. 2 and other figures, brake assemblies 96 and 98 include a pair of cylinders 100 and 102 mounted thereto. A pair of push rods 104 and 106 are connected between the brake assemblies 96 and 98 and disposed to be driven back and forth hydraulically by pistons with the cylinders 100 and 102. The free end of the rod 104 is connected to the brake assembly 98 by means of a connection 108. In like manner, the push rod 106 is attached at the free end to connecting means 110 on the brake assembly 96.

Movements of rods 104 and 106 within their respective cylinders 100 and 102 cause the entire brake assembly 96 and 98 to be moved in opposite directions longitudinally with respect to the side frames 32 and 34. The ends of the brake assemblies 96 and 98 include ends similar to the end 128 illustrated in FIG. 6 which are adapted to be fitted into the assemblies 28, 30, 74 and 76 of the general type 80 also illustrated in FIG. 6. Inboard of the support members 28, 30, 74 and 76, there are disposed a plurality of brake shoes 112, 114, 116, 118 which are securely mounted through suitable projecting portions to the brake units 96 and 98. The brake shoes move in and out to provide braking or non-braking in accordance with the operation of the brake unit. For example, when the brake assembly 96 is moved to the left as a result of the cylinder 102 pushing the rod 106, the brake shoes 112 and 118 will contact the wheels 20 to provide a braking action. In like manner, when the brake assembly 98 is moved to the right by the cylinder 100 pushing the rod 104, the brake shoes 114 and 116 will contact the wheels 22 to provide a braking action. Outwardly disposed on the brake unit 96 and 98 are the ends 120, 122, 124 and 126. These ends form an integral part of the structure of the brake units 96 and 98. The end guide sections 120, 122, 124 and 126 ride within wear elements within the angle supports which form parts of the assemblies 28, 30, 74 and 76. As mentioned, this arrangement is illustrated in detail in FIG. 6 where support 80 is illustrated.

It is noted that in conventional brake systems, that it is desirable to have the brake shoes contact the wheels at an upwardly extending angle. One reason for this is that when the brakes are released, the brakes will fall back as a result of gravity forces. As a result of experience, it was found that an angle between the direction of brake application towards the axis of the wheels should be about 14°. In other words the angle supports for the brake assemblies should extend upwardly from the horizontal plane about 14°. The various mechanisms for providing a hand brake involving various rods and linkages to provide mechanical braking are not illustrated since they are not related to the present invention.

As seen and illustrated, the present invention provides identical support members which are permanently secured to the sideframes. The members are adapted to receive plate elements with angular elements attached thereto for guiding the movement of the brake units. The plate and angular elements are made of substantially identical parts. Depending upon the wheels to be braked, the angular elements for guiding are connected to one or the other side of its associated plate which is attached to the main support. In some cases, when larger wheels are involved, the angular guide elements may be recessed. Reversal of the assemblies with angular members mounted on opposite sides of their associated plates with result in the angular members being disposed at the same correct angles for different size wheel sets located inboard or outboard.

What is claimed is:

1. A railway car truck for supporting a pair of brake units for front and rear sets of wheels comprising:

a. a pair of side frames, b. a pair of front and rear brake beam guide support assemblies disposed between said sets of wheels and connected to said side frames to support said pair of brake units, c. each of said brake beam guide support assemblies including a main tubular member fixedly secured at one end to said sideframes of said truck with a plate secured to its free end, d. a separate second plate attachable to each of said plates in a first position to accommodate a first given wheel size, said second plates being constructed and arranged such that they can be movable to a second position to accommodate a wheel size different from said first wheel size, and e. angle guide members detachably mounted to each of said second plates to receive and guide the movements of said brake units.

2. A railway truck as set forth in claim 1 wherein said pair of front and rear beam guide support assemblies are secured outboard of said side frames.

3. A railway truck as set forth in claim 2 wherein the main tubular members with attached plates are secured outboard of the wheels on said truck.

4. A railway truck as set forth in claim 3 wherein each of said angle guide members extend inwardly from said plate towards said side frames to support and guide the ends of said brake units.

5. A railway truck as set forth in claim 4 wherein said angle guide members extend upwardly towards the axis of the wheels of said car to permit said brake units to be released by gravity when they are not applied.

6. A railway car as set forth in claim 5 wherein a wear plate is disposed between each of said angle guide members to receive one end of said brake units therein.

7. A railway car as set forth in claim 6 wherein aligned openings are provided to permit said second plate to be bolted to said plate.

8. A railway truck as set forth in claim 7 wherein said wear plates include projections disposed to snap into openings in said angle guide members.

9. A railway truck as set forth in claim 8 wherein said second plate is straight on one side edge and angular on its opposite side edge.

10. On a railway car supported on a truck having a pair of side frames, a front wheel set and a rear wheel set, each of said wheel sets rotatably secured to said side frames and a brake assembly for each wheel of each set, adjustable brake support and guide assemblies secured to said side frames for moveably supporting said brake assemblies adjacent each wheel, each of said brake support and guide assembly including a mounting means secured to a side frame, and adjustable plate adapted to be attached to said mounting means in at least two positions for accommodating wheels of different diameters, said adjustable plate having guide means secured thereto for slidably supporting a portion of a brake assembly, and each of said adjustable plates being moveable from one position at a wheel on one side of the railway car to a second position at a diagonally opposite wheel on the other side of the railway car, whereby one wheel size is accommodated in one position and a second wheel size is accommodated in the second position.

* * * * *